US007798047B1

(12) United States Patent
Moody

(10) Patent No.: US 7,798,047 B1
(45) Date of Patent: Sep. 21, 2010

(54) MACHINE GUN AMMUNITION HOLDER INCORPORATING CENTER OF GRAVITY DOWNWARD EJECTION-DEFLECTOR

(76) Inventor: Joseph R. Moody, 738 Natures Hammock Rd. W., Jacksonville, FL (US) 32259

( * ) Notice: Subject to any disclaimer, the term of this patent is extended or adjusted under 35 U.S.C. 154(b) by 553 days.

(21) Appl. No.: 11/745,643

(22) Filed: May 8, 2007

(51) Int. Cl.
*F41A 9/79* (2006.01)

(52) U.S. Cl. ..... 89/33.16; 89/34

(58) Field of Classification Search ..... 89/33.4, 89/34, 33.16
See application file for complete search history.

(56) References Cited

U.S. PATENT DOCUMENTS

| | | | | |
|---|---|---|---|---|
| 2,323,430 | A * | 7/1943 | Trotter | 89/33.4 |
| 3,293,986 | A | 12/1966 | Stoner | |
| 3,640,177 | A * | 2/1972 | Hottinger | 89/33.4 |
| 3,687,003 | A * | 8/1972 | Zurbuchen et al. | 89/36.13 |
| 4,389,918 | A | 6/1983 | Peck | 89/34 |
| 4,715,141 | A | 12/1987 | Kohnke | |
| 4,753,155 | A | 6/1988 | Balister | 89/34 |
| 4,939,979 | A | 7/1990 | Capawana | 89/34 |
| 5,651,208 | A * | 7/1997 | Benson | 42/98 |
| 6,675,693 | B1 | 1/2004 | Heayn | 89/34 |
| 6,799,500 | B1 | 10/2004 | Kulikowski | 89/34 |
| 2008/0092728 | A1 | 4/2008 | Stussak | |
| 2008/0140514 | A1 | 6/2008 | Stenger | |

* cited by examiner

*Primary Examiner*—Stephen M Johnson
(74) *Attorney, Agent, or Firm*—Brian S. Steinberger; Law Offices of Brian S. Steinberger, P.A.

(57) ABSTRACT

Devices, apparatus, systems and methods of mounting ammunition holders for side loading machine guns and weapons that downwardly eject spent cartridges. The ammunition holders include a side place that both moves the center of gravity of the left side supported ammunition holder to move in a right direction underneath the machine gun until the ammunition holder is balanced relative to the machine gun. The side plate further deflects the spent cartridges from being directly ejected downward from the machine gun and instead deflect the spent cartridges to one side of the machine gun away from both the machine gun and an operator of the gun. The ammunition containers can be ammunition belt boxes. The ammunition containers can be ammunition pouch bags.

18 Claims, 8 Drawing Sheets

MACHINE GUN AMMUNITION HOLDER INCORPORATING CENTER OF GRAVITY DOWNWARD EJECTION-DEFLECTOR

This invention relates to machine guns, and in particular to devices, apparatus, systems and methods of mounting and using machine gun ammunition holders, namely ammunition belt boxes and pouch bags, where the center of gravity of the mass and the weight of side mounted ammunition holders is pulled and moved to an overall balanced position relative to the machine gun, and the holder incorporates a deflector for deflecting downwardly ejecting spent cartridge cases from the gun.

BACKGROUND AND PRIOR ART

Popular machine guns such as the FN(Fabrique Nationale) Mag, the 240/Mag, the German MG3 and MG42/59 machine gun manufactured by Rhinemettall and other licensed and unlicensed copies of these machine guns use either a side hanging drum type box or pouch-bag to store and feed ammunition to the machine gun. FIGS. 1-5 shows a popular machine gun with such as ammunition bag. Such ammunition boxes and bags are needed to hold and bundle linked rounds. However, there are many problems with such side hanging ammunition boxes and bags. These boxes and bags vary in size to hold 50 to 150 linked rounds. The most popular being the 100 round box or bag that weighs approximately 5 pounds.

Spent cartridges are exhausted generally downward from these popular types of machine guns and can hit the soldier/operator. Also, if the machine gun is mounted on a stand above a ground surface, the spent cartridges can bounce down and reflect up hitting the soldier/operator as well.

Pouch bags made from fabric material can easily become damaged and ruined by the downwardly ejected spent cartridges. For example, spent cartridges that bounce against a ground surface can also bounce up striking the fabric surfaces of the pouch bag and both damage and further ruin the pouch bag.

Furthermore, the weight and mass of the side hanging ammunition box and bag causes other problems since the current boxes and bags solely hang to one side of the firearm, which pulls the firearm off-balance and to one side. The current hanging boxes and bags create a side pulling weight that tends to cause the soldier/operator to overcompensate the weight to one side of the firearm in order to orient the firearm into a firing position. This constant repositioning can affect the aim and resulting shots from the machine gun.

Additionally, the weight and mass of the side hanging bags and boxes also makes the firearms difficult to carry and move into place. Additional seconds of extra time to carry and position the firearm can affect the necessity for using the firearm that exist in immediate use applications such as in combat type situations.

Trying to solve these problems by positioning extra bags and/or weights on the opposite side so that the firearm has two bags (or counter-weight) each hanging to one side to balance the firearm does not overcome these problems. The popular machine guns require a feed type belt to the left side of the gun that can only be inserted into one side bag. Thus, in a short time, one bag type side weight would easily outweigh the other side and still cause the side tilting and offset balance problem. Additionally, adding another load does not stop the spent cartridge cases from still ejecting downward and causing the other previously listed problems. Still furthermore, using extra bags and/or opposite side weights would make the carrying and positioning the machine gun impractical and tedious to use. The extra mass and weight of using additional bags (or counter-weight(s)) would add unnecessarily carrying loads to the operator/soldier who already is required to carry a substantial amount of gear.

Thus, the need exists for solutions to the above problems with the prior art.

SUMMARY OF THE INVENTION

This invention pertains to only downward ejecting belt fed machine guns which eject empty shells down through the central receiver which makes it virtually impossible to utilize a center of gravity belt box or bag. Many belt fed machine guns utilize side ejecting models which eject empty shells to the side of the machine gun which allows these guns to incorporate a center of gravity ammunition belt or box directly under the weapon to enhance balance with proper center of gravity. These side ejection machine guns are not pertinent to this invention as they need no empty round deflector.

This novel ammunition holder and deflector have plural benefits. The ammunition holder deflects the downwardly ejected spent shells from the machine gun to the right side and allows an ammunition box and bag to be generally positioned under the weapon for a proper center of gravity location. Additionally, the ammunition holder and deflector is used to pull the ammunition box or bag to a right angle in order to position the major mass of ammunition in the box or bag to the right to balance the left hanging ammunition box or bag which these weapons use.

A primary objective of the present invention is to provide devices, apparatus, systems and methods of mounting and using machine gun ammunition holders, namely ammunition belt boxes and pouch bags, where the center of gravity of the ammunition holders is moved to an overall balanced position relative to the gun, and the holders incorporate deflectors for deflecting downwardly ejecting spent cartridges from the machine gun to one side of the gun.

A secondary objective of the present invention is to provide devices, apparatus, systems and methods of mounting and using machine gun ammunition holders, namely ammunition belt boxes and pouch bags, where existing ammunition holders can be retrofitted so that a bottom edge portion of the holders are moved from a left side of the gun underneath the gun to the right until the overall mass of the bag balance the gun, and the holder incorporate deflectors for deflecting downwardly ejecting spent cartridge cases to the right side from the machine guns.

A third objective of the present invention is to provide devices, apparatus, systems and methods of mounting and using machine gun ammunition holders, namely ammunition belt boxes and pouch bags, the prevent downwardly ejecting spent cartridge cases from hitting the operator/soldier.

A fourth objective of the present invention is to provide devices, apparatus, systems and methods of mounting and using machine gun ammunition holders, namely ammunition belt boxes and pouch bags, where the center of gravity of the mass of the holders is pulled and moved to an overall balanced position relative to the gun while portions of the holders deflect downwardly ejecting spent cartridge cases to the side of the gun, without adding substantial weight, mass or gear to the machine gun.

In a preferred embodiment, a side belt loading machine gun that downwardly dispenses spent cartridges from an ejector under the gun uses a novel deflector with a ammunition holder that deflects the downwardly directed spent cartridges to one side of the gun, and has a substantial portion of the bag moved from a left side of the gun underneath the gun to the right until the overall mass of the bag balances the weapon.

An ammunition holder for machine guns that downwardly eject spent cartridge cases, can include an ammunition container for holding plural linked rounds of belted ammunition, wherein the container has an overall weight and mass, a mount mechanism for attaching the container to a side belt feeder on one side of the machine gun, the container having an outer side facing away from the machine gun and an inner side facing underneath the machine gun, and a plate attached to the inner side of the ammunition container. The plate moves the center of gravity of mass and weight of the plural lined rounds of the belted ammunition held in the ammunition container from the one side of the machine gun underneath the gun in the direction of an opposite side of the machine gun until the center of gravity of the mass and weight of the container balances the machine gun, and wherein the plate deflects the downwardly ejected spent cartridges from the machine gun to a side of the machine gun away from both the machine gun and the operator of the machine gun.

The ammunition container can include a pouch bag having a fabric surface.

The ammunition container can include a polymer and/or plastic ammunition box.

The ammunition container can include a metal ammunition box.

The plate can be formed from a group selected from one of a polymer, a plastic and a fiberglass, and combinations thereof, and the like.

The plate can be formed from a group selected from one of steel, galvanized metal and aluminum, and the like, and combinations thereof.

The plate can be an angled plate.

The plate can be a planar-plate with a bent portion.

The plate can include a concave curved surface.

The plate can be a right triangular plate.

The invention can include a novel method of mounting ammunition holders to machine guns having downwardly ejecting spent cartridge cases, comprising the steps of providing a machine gun with a belt ammunition feeder on one side of the machine gun, and a bottom ejector that downwardly ejects spent cartridge cases, the machine gun, having a center of gravity, attaching an ammunition holder that holds a bundle of linked rounds to the side belt feeder on the machine gun, the ammunition holder with the bundle of linked rounds having a mass and weight with a center of gravity, and moving the center of gravity of the mass and the weight of the ammunition holder to an overall balanced position relative to the gun.

The method can further include the steps of deflecting the spent cartridge cases from being ejected directly downward by a surface portion of the ammunition holder to one side of the machine gun away from both the machine gun and an operator of the machine gun.

The deflecting step can includes the step of providing an angled plate on an inner side of the ammunition holder.

The method can further include the steps of providing a kit having the angled plate and fasteners for attaching the plate to the ammunition holder, and performing the attaching and deflecting steps to a pre-existing machine gun and ammunition holder.

The moving step and the deflecting step can both includes the step of providing an angled plate on an inner side of the ammunition holder that dually both adjusts the center of gravity of the ammunition holder and deflects the downwardly ejecting spent cartridges to the side of the machine gun.

The moving step and the deflecting step can includes the step of pulling and moving the center of gravity of the mass and the weight of the ammunition holders from the one side of the weapon underneath the weapon toward an opposite side direction to a balanced position relative to the machine gun.

The invention can be included with an improved automatic machine gun that includes a machine gun having a side belt ammunition loader on a left side, with a bottom ejector for downwardly ejecting spent cartridge cases beneath the machine gun, an ammunition container for holding plural rounds of the belt linked ammunition, with a mount mechanism for attaching the container to the side belt feeder on the left side of the machine gun, the container having an outer side facing away from the machine gun and an inner side facing underneath the machine gun, the container with the belt linked ammunition having a mass and a weight with a center of gravity, and a plate attached to the inner side of the ammunition container for bending the container so that the center of gravity of the mass and weight of the ammunition container is moved from the left side to a right side underneath the machine gun in order to balance the mass and the weight of the ammunition container relative to the machine and, and wherein the plate deflects spent cartridges ejected downwardly from the machine gun to one side of the machine gun away from both the machine gun and an operator.

The ammunition container can be a pouch bag having a fabric surface.

The ammunition container can be a plastic and/or polymer ammunition box.

The ammunition container includes a metal ammunition box.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A listing of the components will now be described.

Figure 1:
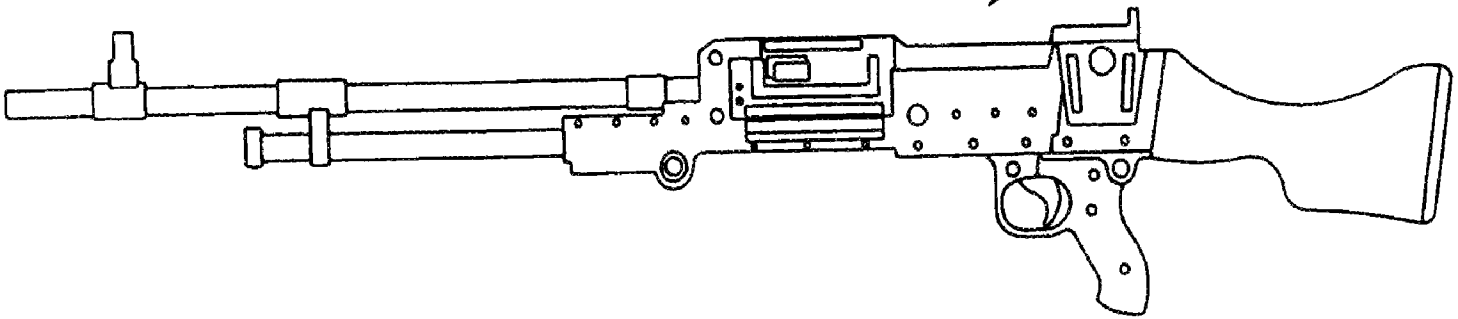
Fig.1 (Prior Art)
FIG. 1 shows a left side view of a prior art machine gun.
Figure 2:
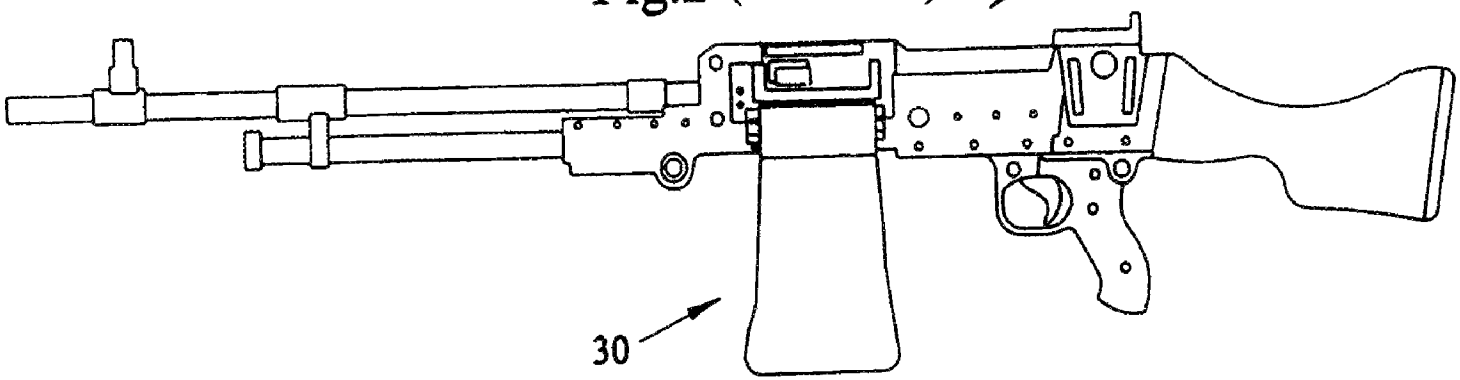
Fig.2 (Prior Art)
FIG. 2 shows the left side machine gun of FIG. 1 with an ammunition holder.
Figure 3:
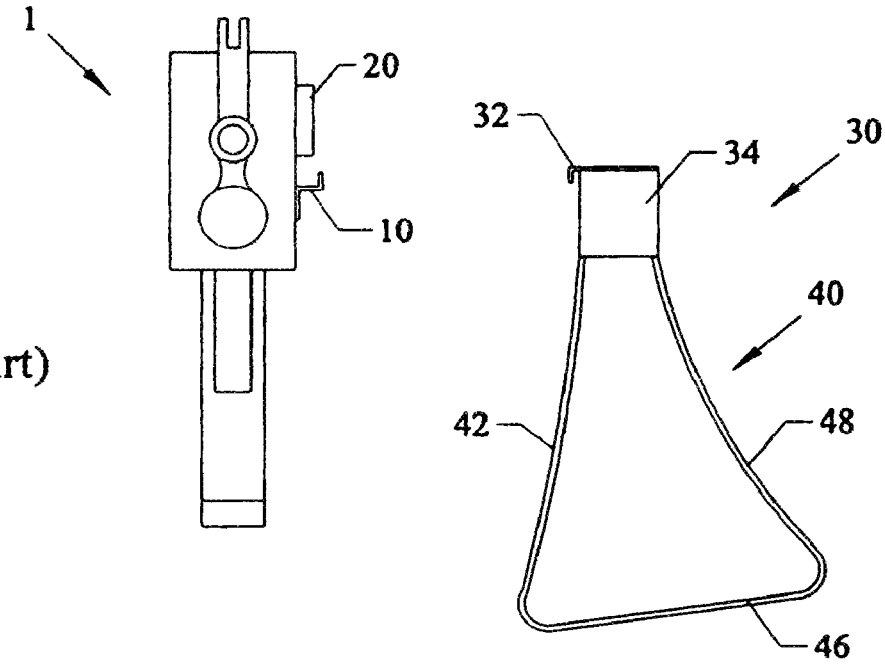
Fig.3 (Prior Art)
FIG. 3 shows a front view of the machine gun of the preceding figures separated from an ammunition holder.

Machine Gun 1
Ejection Port 5 for Spent cartridges 55
Left Side Ammunition Holder Mount 10
Left Side Belt Feeder 20
Ammunition Holder 30
Clip on ammunition holder 32
Upper Neck to Holder 34
Ammunition Bag 40
Inner side 42 of Ammunition Bag 40
Bottom side 46 of Ammunition Bag 40
Outer side of 48 Ammunition Bag 40
Belt ammunition rounds 50
Single fed belt 52
Spent cartridges 55
Angled Plate 100
Top of angled plate 110
Inside wall of angled plate 130
Outside wall of angled plate 160
Bottom of angled plate 180
Fasteners 200
Flat plate 300
Rigid seam 400
Shell/clam/sides 410, 420
Right triangular box/bag 500 with rigid deflector side
Triangular box/bag 600 with concave curved rigid deflector side FIG. 1 shows a left side view of a popular prior art machine gun 1 such as a FN(Fabrique Nationale) Mag, the 240/Mag machine gun, the German MG3 machine gun. FIG. 2 shows the left side machine gun 1 of FIG. 1 with an ammunition holder 30 such as an ammunition pouch bag made from a fabric material, such as but not limited to the pouch bags shown and described in U.S. Pat. Nos. 6,675,693 to Heayn and 6,799,500 to Kulikowski, which are both incorporated by reference. FIG. 3 shows a front view of the machine gun 1 of the preceding figures along arrow F separated from an ammunition holder 30.

Figure 4:
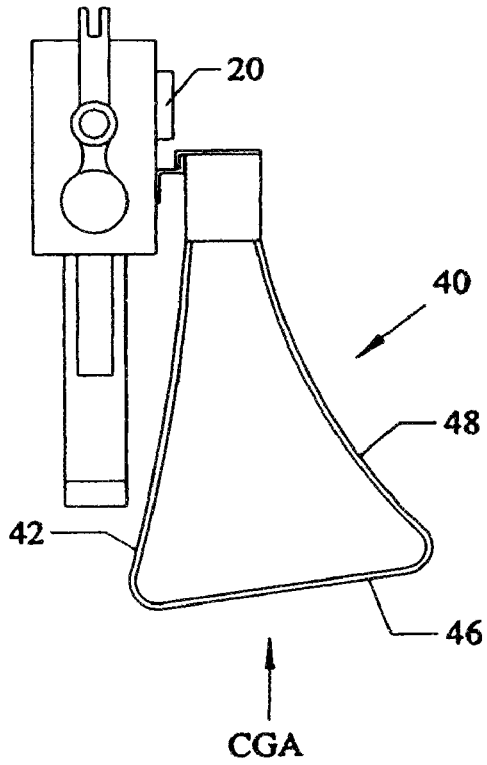
Fig.4 (Prior Art)
FIG. 4 shows another front view of the prior art machine gun of FIG. 2 with the ammunition holder attached to the machine gun.
Figure 5:
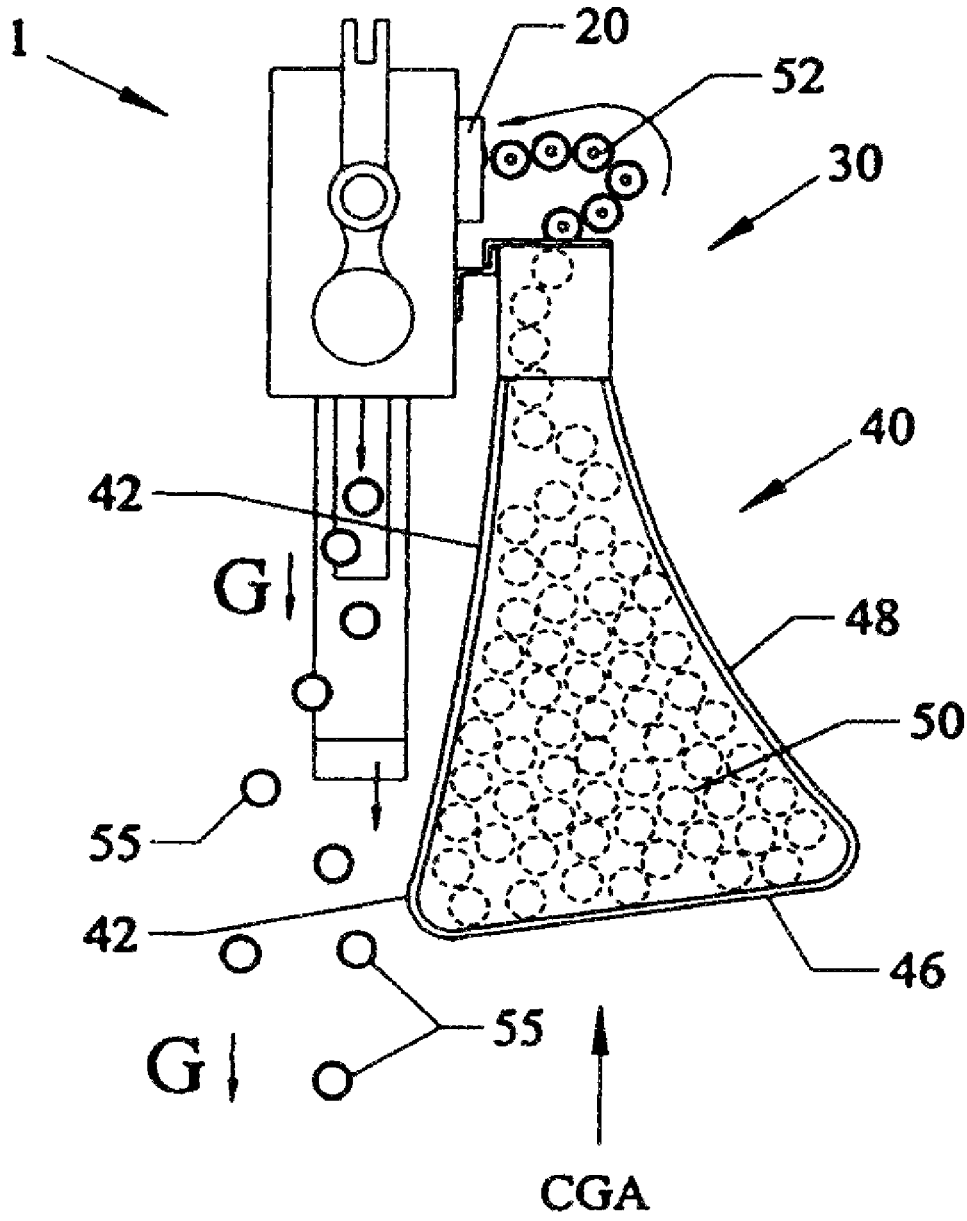
Fig.5 (Prior Art)
FIG. 5 is another view of the machine gun with attached ammunition holder showing spent cartridge shells being ejected in a downward direction.

FIG. 4 shows another front view of the prior art machine gun 1 of FIG. 2 with the ammunition holder 30 attached to the machine gun 1 by mounting ammunition holder clip 32 onto the existing mount 10 on the left side of the machine gun. FIG. 5 is another view of the machine gun with attached ammunition holder 30 with a bag 40 full of belt linked rounds 50 and a single fed belt 52 exiting the top of the ammunition holder 30 and being fed into the left side belt feeder 20 of the machine gun 1. FIG. 5 further show the spent cartridges 55 being ejected downward in the direction of arrow G.

Referring to FIGS. 1-5, the majority of the mass and resulting center of gravity of the full ammunition holder 30 is located off to the left side of the gun 1, which as discussed in the background section of the invention pulls the gun 1 to the left in an off-balance orientation. Additionally, the lower inner side 42 of the hanging bag 40 hangs close to and can have a partial edge that can sometimes interfere with ejected spent cartridges 55. Pouch bags made from fabric material can easily become damaged and ruined by the downwardly ejected spent cartridges 55 that bounce against a ground surface and bounce up striking the unprotected fabric bottom 46 of the pouch bag 40, and both damage and further ruin the pouch bag 40. Also, as previously discussed the downwardly ejected spent cartridges 55 can potentially injure the operator/soldier that is handling the machine gun 1.

Figure 8:
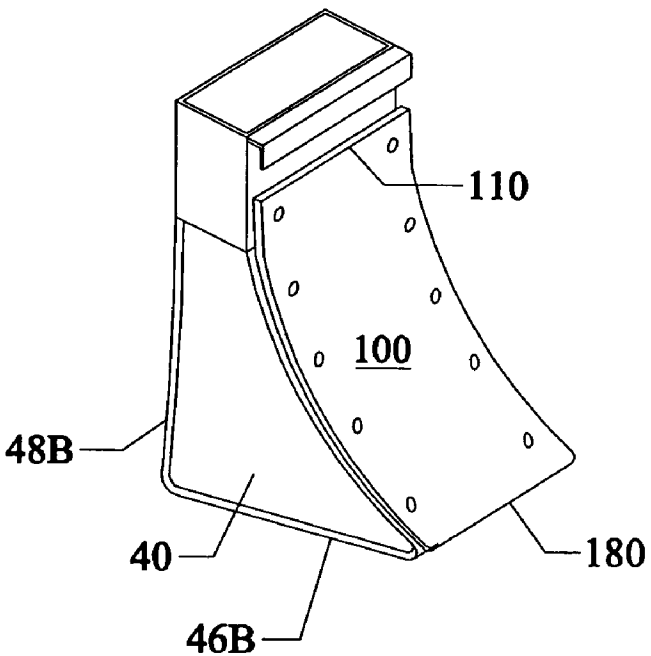
FIG. 8 is another right perspective view of the ammunition holder of FIGS. 6-7 attached to the novel plate.
Figure 6:
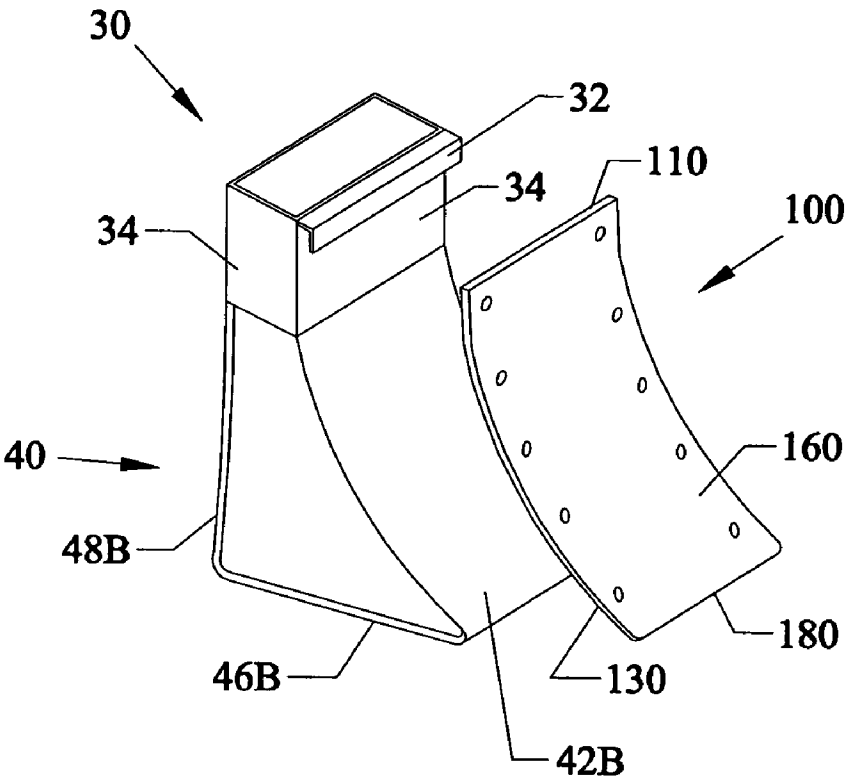
FIG. 6 is a right perspective view of an ammunition holder apart from the novel angled plate.
Figure 7:
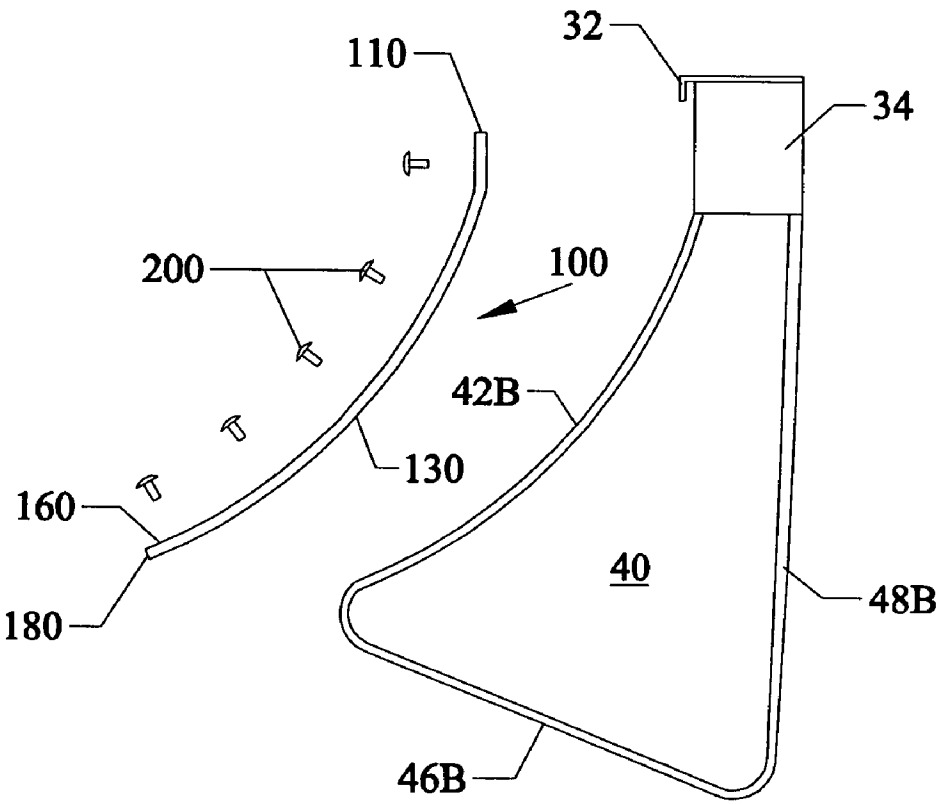
FIG. 7 is a front view of the ammunition holder of FIG. 6 about to be attached to the plate.
Figure 9:
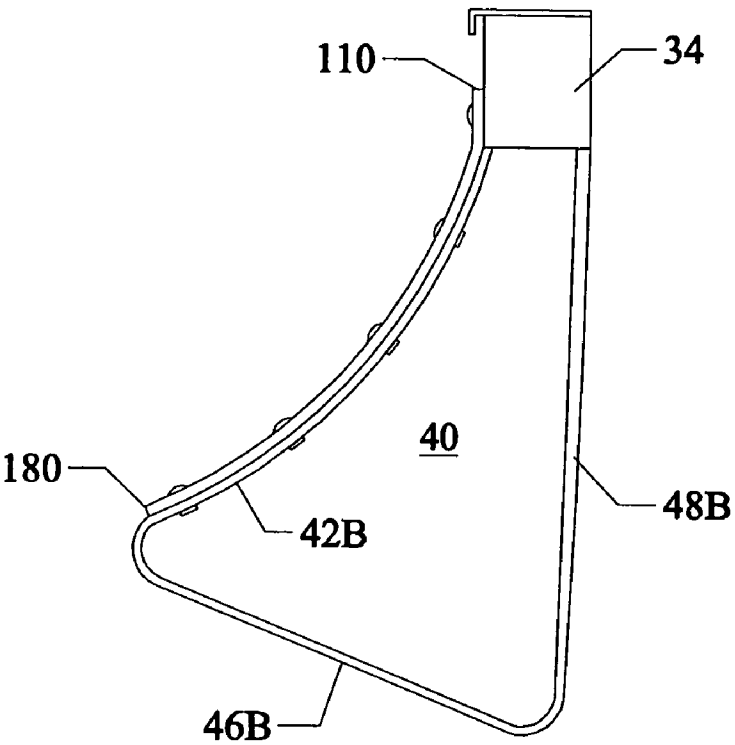
FIG. 9 is a front view of the ammunition holder with attached plate of FIG. 8.

FIG. 6 is a right perspective view of an ammunition holder 40 apart from the novel angled plate 100. FIG. 7 is a front view of the ammunition holder 40 of FIG. 6 about to be attached to the plate 100. FIG. 8 is another right perspective view of the ammunition holder 40 of FIGS. 6-7 attached to the novel plate 100. FIG. 9 is a front view of the ammunition holder 40 with attached plate 100 of FIG. 8.

Referring to FIGS. 6-9, a novel angled plate 100 can be formed from a solid molded material such as polymer, plastic and/or fiberglass. Alternatively, the angled plate 100 can be formed from metal such as aluminum, steel, galvanized steel, stainless steel and the like. The plate 100 must be rigid enough to maintain an angled configuration when attached to the inner side 42 of the pouch bag 40, and be strong enough to reshape the pouch bag 40.

The angled plate 100 Plate can be initially premolded. Alternatively, the plate can be a bent plate. The plate 100 can have a convex curved inner wall 130 and concave curved outer wall 160. Still furthermore, the plate 100 can have an angled planar surface 160 mimicking a right triangle leg. Still furthermore, the plate 100 can have different size angles can correspond to different size ammunition bags and ammunition boxes.

Larger and smaller ammunition bags will allow for the plate 100 to be more angled than smaller ammunition bags containing less ammunition. The novel angled plate can be used with different ammunition bags having approximately 50, approximately 80, approximately 100, approximately 150 rounds to approximately 200 round bags. The novel plate 100 can be used to cover bags having less or more rounds.

A preferred embodiment of the plate 100 can include a top edge 110 that covers up to and over part of the upper neck 34 to the ammunition holder 30, and a bottom edge 180 which covers substantially all of the lower edge portions of the inner wall 42 of the pouch bag 40. The width of the plate 100 can also cover substantially all of the inner wall width of the inner wall 42 of the pouch bag 40.

A preferred application would be to attach the angled plate 100 by fasteners 200 such as but not limited to rivets, as rivets, glue, adhesive, molded, hook and loop fasteners, mushroom head fasteners, screws, tie straps, wire, and the like, to the inner wall 42 of the pouch bag 40. The angled plate 100 is rigid enough to change and reshape of the outer wall 48B, the bottom side 46B and the inner wall 42B of the pouch bag so that the configuration of the bag 40 follows the shape of the angled plate 100, and pulls the entire shape of the bag to one side. Here, a bottom edge portion of the bag is moved from a left side of the gun underneath the gun to the right until the overall mass of the bag balances the weapon.

The size and shape of the bag determines that distance that the bag must be pulled from the left to the right underneath the weapon in order to move the center of gravity of the filled bag to a balance position relative to the gun.

Figure 10:
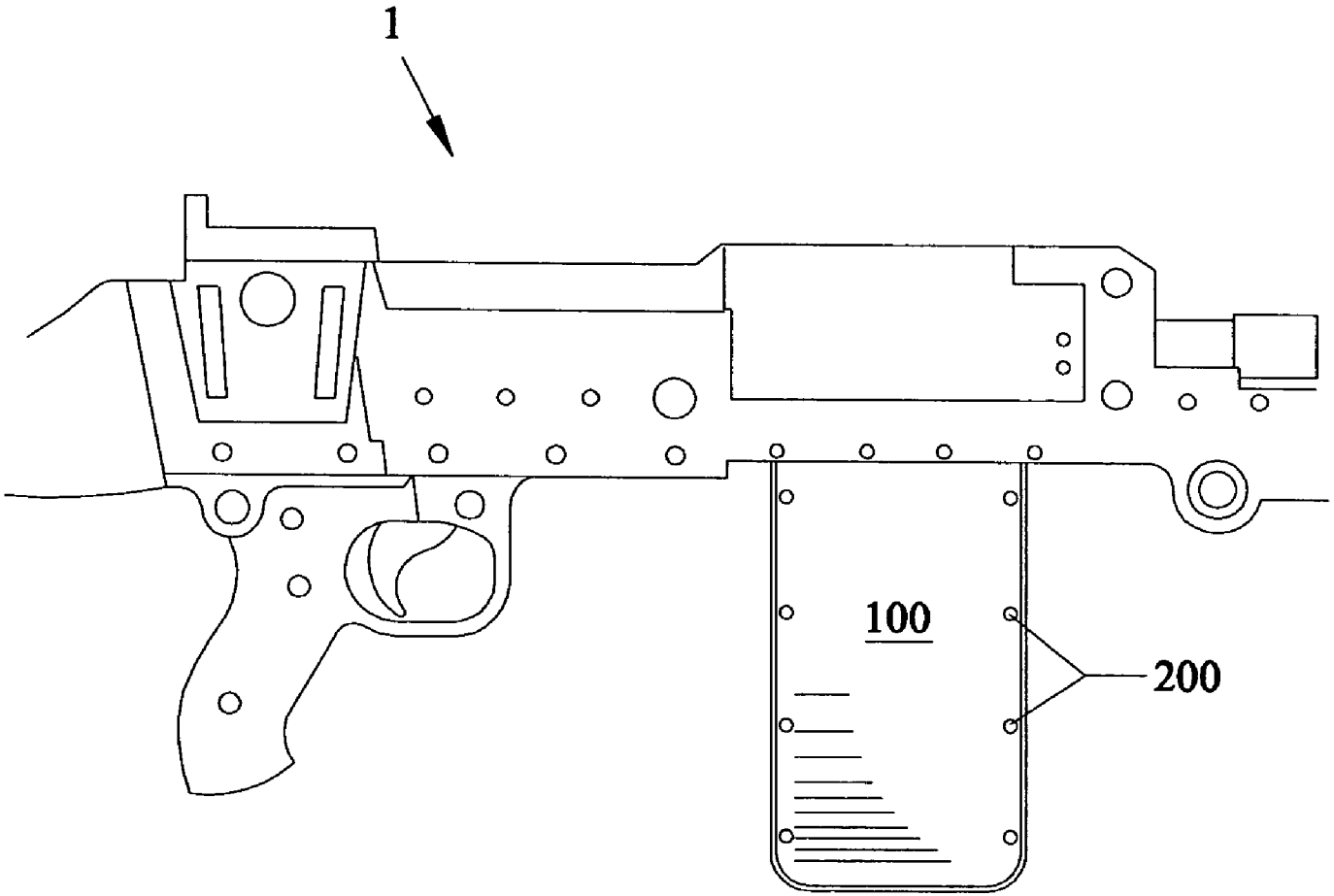
FIG. 10 is a right side view of a machine gun with ammunition holder and attached plate.
Figure 11:
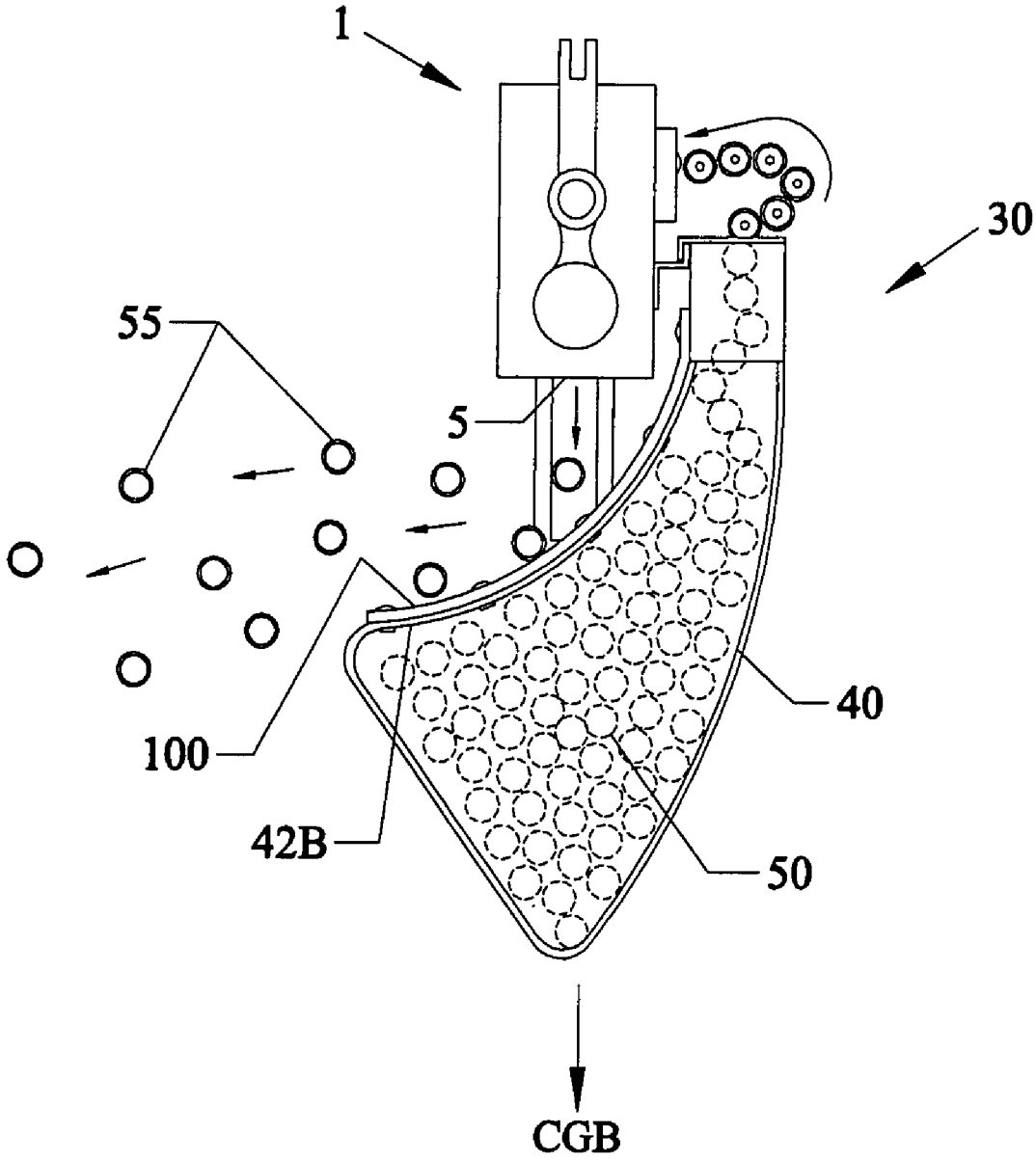
FIG. 11 is a front view of the novel ammunition holder with attached plate mounted to the machine gun with downwardly ejected spent cartridges being deflected to the right side.

FIG. 10 is a right side view of a machine gun 1 with ammunition holder 30 and attached plate 100. FIG. 11 is a front view of the novel ammunition holder 30/40 with attached plate 100 mounted to the machine gun 1 with downwardly ejected spent cartridges 55 being deflected to the left side of the weapon.

Referring to FIGS. 6-11, the attached plate 100 is at a deflection angle beneath machine gun 1 so that the plate 100 must substantially cover the entire inner side 42B of the pouch bag 40 facing the spent cartridge ejection port 5. The deflection plate 100 allows for the downwardly ejected spent cartridges to deflect to the left side of the weapon away from the operator/soldier, and does not allow for the spent cartridges to hit or bounce back to the operator/soldier. Additionally, the spent cartridges 55 are directed away from the pouch bag 40 to the right side away from both the gun and the operator/soldier resulting in no damage to the bag and instead an increased lifespan for the pouch bag 40.

Referring to FIGS. 5, 9 and 11, the novel plate 100 allows for the center of gravity CGB of the ammunition holder 30 with pouch bag 40 to move in a right direction underneath the machine gun 1 until the overall mass of the bag is balanced relative to the weapon. The novel angled deflection plate 100 is able to move the center of gravity of the mass and weight of the supported ammunition rounds 50 to be moved generally beneath the machine gun 1 until a balance of the holder is achieved relative to the machine gun. This novel configuration removes the tilting and off-balance problems and resulting reorientation problems with using the machine gun 1 that were described in the background section of the invention.

The invention can be incorporated by factories that manufacture the pouch bags/boxes. A sleeve, cover, cage, rods, combinations thereof, and the like, can be used on both the outside of a pouch bag/box and/or inside (as inserts) of the pouch bag/box to form both of the deflection surface and to reshape of the bag/box to move the center of the gravity of the bag/box to a balanced position relative to the weapon.

Additionally, the invention can also be used with kits where existing ammunition pouch bags can be retrofitted with the novel angled plate 100. A novel kit can include a pre-sized angled plate 100 and fasteners 200 such as rivets, glue, molded, adhesive, hook and loop fasteners, mushroom head fasteners, screws, tie straps, wire, and the like, with directions of how to attach the plate to the pouch bag 40. The kit can also include the sleeve, cover, cage, and the like, referenced above.

The invention can be used with solid belt ammunition boxes having rigid sides, where a separate angled plate can be manufactured and/or formed and/or retrofitted on an inner or outer side of the box so that the center of gravity of the filled box is balanced relative to the machine gun. Also, the whole side of the box can be formed as the deflector. Additionally, the inner side of the ammunition box can be pre-molded into an angular plate configuration as described above forming both a dual purpose of having the center of gravity of the ammunition box moved under the center of gravity of the machine gun as well as form a deflector surface for deflecting the downwardly ejecting spent cartridges to a right side of the machine gun away from the operator/soldier.

Figure 14:
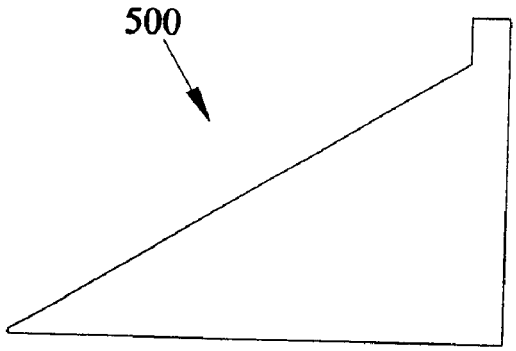
FIG. 14 shows a right triangular box/bag embodiment with rigid angled side deflector.
Figure 15:
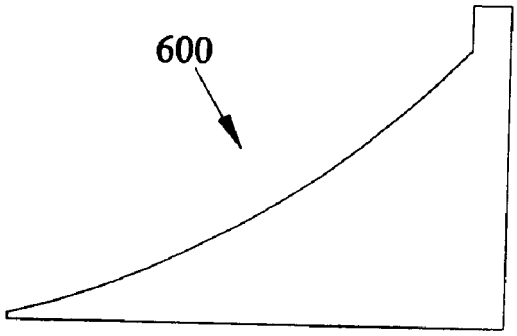
FIG. 15 shows a triangular box/bag embodiment with a rigid concave curved side deflector.
Figure 12:
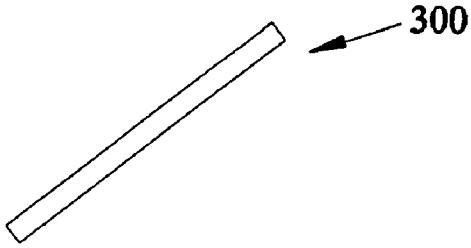
FIG. 12 shows a side view of a flat plate that can be incorporated with the invention.
Figure 13:
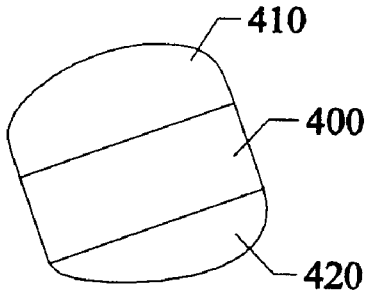
FIG. 13 shows a plate type seam that can be incorporated into the invention.

Additional shapes of the bags/boxes can be used. FIG. 12 shows a side view of a flat plate 300 that can be incorporated with the invention. FIG. 13 shows a plate type seam 400 that attaches bag/container sides/shells that can be incorporated into the invention. FIG. 14 shows a right triangular box/bag embodiment 500 with rigid angled side deflector that can be formed thereon and/or attached as described in the previous embodiment. FIG. 15 shows a triangular box/bag embodiment 600 with a rigid concave curved side deflector that can be formed thereon and/or be attached as described in the previous embodiment.

The boxes and the bags can have different shapes such as but not limited to a right triangular shape, trapezoid shape, hexagon shape, oblong shape, and any other workable shape, as long as an angled deflector portion is included to deflect the downwardly ejecting spent cartridges to one side of the weapon.

As discussed, the embodiment of the preceding figures can be used with both pouch bags and belt boxes. The size and shape of the bag and box determines that distance that the bag and box must be oriented in order to move the center of gravity of the filled bag/box to a balanced position relative to the gun and eliminate the tilting and problems of the prior art.

Although the preferred embodiments are for using the novel angled plate with ammunition pouch bags and ammunition boxes on machine guns, the invention would have applicability to other weapons where the ammunition holders is on the right side of an automatic or semi-automatic weapon and ejects spent cartridges downward as well. Additionally, the invention can deflect downwardly ejected spent cartridges to the left side of the weapon as well away from both the weapon and the operator/soldier.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. An ammunition holder for machine guns that downwardly eject spent cartridge cases, comprising:

an ammunition container for holding plural linked rounds of belted ammunition, wherein the container has an overall weight and mass with a center of gravity;

a mount mechanism for attaching the container to a side belt feeder on one side of the machine gun, the container having an outer side facing away from the machine gun and an inner side facing underneath the machine gun; and a rigid plate attached to the inner side of the ammunition container for moving the ammunition container, so that the center of gravity of the mass and weight of the plural linked rounds of the belted ammunition held in the ammunition container is moved from the one side of the machine gun underneath the gun in the direction of an opposite side of the machine gun and be located directly under the machine gun, and the center of gravity of the mass of the container along with the center of gravity of the belted ammunition held in the ammunition container balances the machine gun, and wherein the solid rigid plate deflects spent cartridges ejected downwardly from the machine gun to a side of the machine gun.

2. The ammunition holder of claim 1, wherein the ammunition container includes:

a pouch bag having a fabric surface.

3. The ammunition holder of claim 1, wherein the ammunition container includes:

an ammunition box formed from at least one of: a polymer and a plastic.

4. The ammunition holder of claim 1, wherein the ammunition container includes:

a metal ammunition box.

5. The ammunition holder of claim 1, wherein the rigid plate is formed from a group selected from one of: polymer, plastic and fiberglass.

6. The ammunition holder of claim 1, wherein the rigid plate is formed from a group selected from one of: steel, galvanized metal and aluminum.

7. The ammunition holder of claim 1, wherein the rigid plate includes:

an angled plate.

8. The ammunition holder of claim 1, wherein the rigid plate includes:

a planar-plate with a bent portion.

9. The ammunition holder of claim 1, wherein the rigid plate includes:

a concave curved surface.

10. The ammunition holder of claim 1, wherein the rigid plate includes:

a right triangular plate.

11. The ammunition holder of claim 1, wherein the rigid plate is a solid rigid plate.

12. The ammunition holder of claim 1, wherein the rigid plate includes:

an upper end adapted to be adjacent to the one side of the machine gun, and a lower end adapted to be angled underneath the machine gun.

13. An improved automatic machine gun comprising:

a machine gun having a side belt ammunition loader on a left side, with a bottom ejector for downwardly ejecting spent cartridge cases beneath the machine gun;

an ammunition container for holding plural rounds of belt linked ammunition, with a mount mechanism for attaching the container to the side belt feeder on the left side of the machine gun, the container having an outer side facing away from the machine gun and an inner side facing underneath the machine gun, the container with the belt linked ammunition having a mass and a weight with a center of gravity; and a rigid plate attached to the inner side of the ammunition container for bending the container so that the center of gravity of the ammunition container with the center of gravity of the ammunition is moved from the left side to a right side to be underneath the machine gun in order to balance the machine gun , and wherein the plate deflects spent cartridges ejected downwardly from the machine gun to one side of the machine gun away from both the machine gun and an operator.

14. The improved automatic machine gun of claim 13, wherein the ammunition container includes:

a pouch bag having a fabric surface.

15. The improved automatic machine gun of claim 13, wherein the ammunition container includes:

an ammunition box formed from at least one of a polymer and a plastic.

16. The improved automatic machine gun of claim 13, wherein the ammunition container includes: a metal ammunition box.

17. The improved automatic machine gun of claim 13, wherein the rigid plate is a solid rigid plate.

18. The improved automatic machine gun of claim 13, wherein the rigid plate includes:

an upper end adapted to be adjacent to the one side of the machine gun, and a lower end adapted to be angled underneath the machine gun.

* * * * *